US008813287B2

(12) United States Patent
Saubert

(10) Patent No.: US 8,813,287 B2
(45) Date of Patent: Aug. 26, 2014

(54) AUTOMATED LAUNDRY SYSTEM

(75) Inventor: Michael Saubert, Hoffman Estates, IL (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 423 days.

(21) Appl. No.: 12/851,340

(22) Filed: Aug. 5, 2010

(65) Prior Publication Data

US 2011/0030148 A1 Feb. 10, 2011

Related U.S. Application Data

(60) Provisional application No. 61/232,145, filed on Aug. 7, 2009.

(51) Int. Cl.

| | |
|---|---|
| ***D06F 29/00*** | (2006.01) |
| ***D06F 33/02*** | (2006.01) |
| ***D06F 37/04*** | (2006.01) |
| ***D06F 35/00*** | (2006.01) |

(52) U.S. Cl.
USPC ..... 8/158; 68/9; 68/12.23; 68/19.2; 68/20

(58) Field of Classification Search
USPC ..... 68/9, 10, 11, 12.12, 12.23, 19.2, 20, 27
See application file for complete search history.

(56) References Cited

U.S. PATENT DOCUMENTS

| | | | | |
|---|---|---|---|---|
| 2,645,914 | A * | 7/1953 | Sessions | 68/10 |
| 2,887,354 | A * | 5/1959 | Lichtenstein et al. | 8/159 |
| 6,481,248 | B2 * | 11/2002 | Willis | 68/19.2 |
| 6,588,238 | B1 * | 7/2003 | Reason | 68/24 |
| 6,671,978 | B1 * | 1/2004 | McGowan et al. | 34/596 |
| 6,978,556 | B1 * | 12/2005 | Cornelious | 34/596 |
| 7,404,303 | B1 * | 7/2008 | Barbosa et al. | 68/3 R |
| 2003/0154560 | A1 * | 8/2003 | Behrens et al. | 8/159 |
| 2007/0084254 | A1 * | 4/2007 | Messina | 68/142 |
| 2007/0169519 | A1 | 7/2007 | Hershey et al. | |
| 2008/0236206 | A1 * | 10/2008 | Diederiks | 68/19 |
| 2011/0030150 | A1 * | 2/2011 | Ashrafzadeh et al. | 8/159 |

OTHER PUBLICATIONS

Washing-Machine-Wizard, "Washing Machine and Combo History", copyright 2007, http://www.washing-machine-wizard.com/washer-dryer-history.html.*

* cited by examiner

*Primary Examiner* — Joseph L Perrin
(74) *Attorney, Agent, or Firm* — McAndrews, Held & Malloy, Ltd.

(57) ABSTRACT

An embodiment of the present invention is directed to an automated laundry system. The system includes a number of perforated clothes drums, each of which holds a single load of laundry, and a washer/dryer unit. The washer/dryer unit includes a loading rack for queuing the drums for subsequent washing, a clothes washing component adapted to sequentially receive the drums from the loading rack and wash the respective loads of laundry therein, a clothes drying component adapted to sequentially receive the drums from the clothes washing component and dry the loads of laundry therein, and a holding rack for sequentially receiving the drums from the clothes drying component and holding the drums for a period of time.

22 Claims, 12 Drawing Sheets

AUTOMATED LAUNDRY SYSTEM

CLAIM OF PRIORITY UNDER 35 U.S.C. §119

The present application for patent claims priority to Provisional Application No. 61/232,145 entitled "Automated Laundry System" filed Aug. 7, 2009, and assigned to the assignee hereof and hereby expressly incorporated by reference herein.

BACKGROUND

1. Field

Embodiments of the present invention generally relate to the field of laundry appliances.

2. Background

Many households generate enormous amounts of laundry requiring large amounts of time to wash, transfer, dry, transfer, and fold/put away several loads. As a result, recent efforts have been made to develop systems for automating the laundry process. However, these systems that have been developed to date have significant drawbacks.

U.S. Pat. No. 6,671,978 to McGowan et al. discloses a combination washer/dryer that automatically moves laundry from the washer to the dryer and also includes an automatic load-feeder bin. However, the McGowan machine is only capable of queuing up one additional load of laundry while another one is being washed. It is also flawed in that the design assumes that all loads are to be washed at the same settings. In reality, it may be more desirable, for example, to wash one load in hot water and another in cold water, to wash one load in the normal cycle and another in a gentle cycle, etc.

Furthermore, the McGowan machine transfers a load from the washer to the dryer by literally flipping the washer drum upside down and shaking it so as to dump the load into the dryer drum below. It should be appreciated that wet articles of clothing may tend to stick to the sides of a washer drum, particularly after the conclusion of a spin cycle, and therefore it is highly likely that one or more articles may not get transferred to the dryer drum. It is also possible that an article could become snagged on one of the washer drum's perforations or the agitator and likewise not be transferred properly to the dryer drum. As a result, clothing of type (e.g. a white dress shirt) may unintentionally get washed with clothing of another type (e.g. a red sweater), which can often lead to undesirable results—sometimes even ruining clothes completely.

U.S. Publication No. 2007/0169519 to Hershey et al. likewise discloses a combination washer/dryer that automatically moves laundry from the washer to the dryer. The Hershey Publication discloses loading the washer via a load compartment which holds a single, additional load of laundry or, alternatively, via a conveyor belt that dumps clothes into the washer. The Hershey machine suffers from many of the same shortcomings as the McGowan machine. In particular, the Hershey design assumes that all loads are to be washed at the same settings. Also, while the Hershey design uses a slightly different methodology to transfer clothes from the washer to the dryer—namely, dumping the clothes from the washer to the dryer by means of a trap door—the same problems with clothes sticking to the side and/or getting snagged are possible. Furthermore, while the conveyor system disclosed in Hershey may allow for the queuing of multiple additional loads of laundry, it does not provide any means for delimiting between multiple loads. For example, the Hershey machine has no way of knowing where a load of whites ends and a load of colors begins. Thus, the Hershey machine is not suitable for everyday consumer use.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to an automated laundry system. The system includes a number of perforated clothes drums, each of which holds a single load of laundry, and a washer/dryer unit. The washer/dryer unit includes a loading rack for queuing the drums for subsequent washing, a clothes washing component adapted to sequentially receive the drums from the loading rack and wash the respective loads of laundry therein, a clothes drying component adapted to sequentially receive the drums from the clothes washing component and dry the loads of laundry therein, and a holding rack for sequentially receiving the drums from the clothes drying component and holding the drums for a period of time.

Another embodiment of the present invention is directed to an automated laundry system. The system includes a loading component for queuing at least two individual, separated loads of laundry, a washing component for receiving from the loading component, and washing, in succession, each of the at least two loads, and a drying component for receiving from the washing component, drying, and ejecting from the drying component, in succession, each of the at least two loads.

Another embodiment of the present invention is directed to a method for washing multiple loads of laundry in an automated laundry system having a washer and a dryer. The method includes providing a memory for storing washing/drying settings corresponding to each of the loads and a user interface having a display. The method further includes receiving first washing/drying settings corresponding to a first load of laundry via the user interface, storing the first washing/drying settings in the memory, receiving second washing/drying settings corresponding to a second load of laundry via the user interface, and storing the second washing/drying settings in the memory. The method further includes washing the first load of laundry according to the first washing/drying settings, drying the first load of laundry according to the first washing/drying settings, washing the second load of laundry according to the second washing/drying settings, and drying the second load of laundry according to the second washing/drying settings.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Some portions of the detailed descriptions that follow are presented in terms of procedures, logic blocks, processing, and other symbolic representations of operations on data hits within a digital system memory. These descriptions and representations are the means used by those skilled in the data processing arts to most effectively convey the substance of their work to others skilled in the art. A procedure, logic block, process, etc., is herein, and generally, conceived to be a self-consistent sequence of steps or instructions leading to a desired result. The steps are those requiring physical manipulations of physical quantities. Usually, though not necessarily, these physical manipulations take the form of electrical or magnetic signals capable of being stored, transferred, combined, compared, and otherwise manipulated in an electronic device having a processor or microprocessor. For reasons of convenience, and with reference to common usage, these signals are referred to as bits, values, elements, symbols, characters, terms, numbers, or the like with reference to the present invention.

Generally speaking, embodiments provide for an automated laundry system that allows for multiple, separated loads of laundry to be queued up for successive, automated washing and drying. Such a system is capable of washing and drying multiple loads of laundry without the need for subsequent user intervention for sorting the laundry, transferring the laundry from a washer to a dryer, or adjusting the settings of a washer or dryer between loads.

Figure 1:
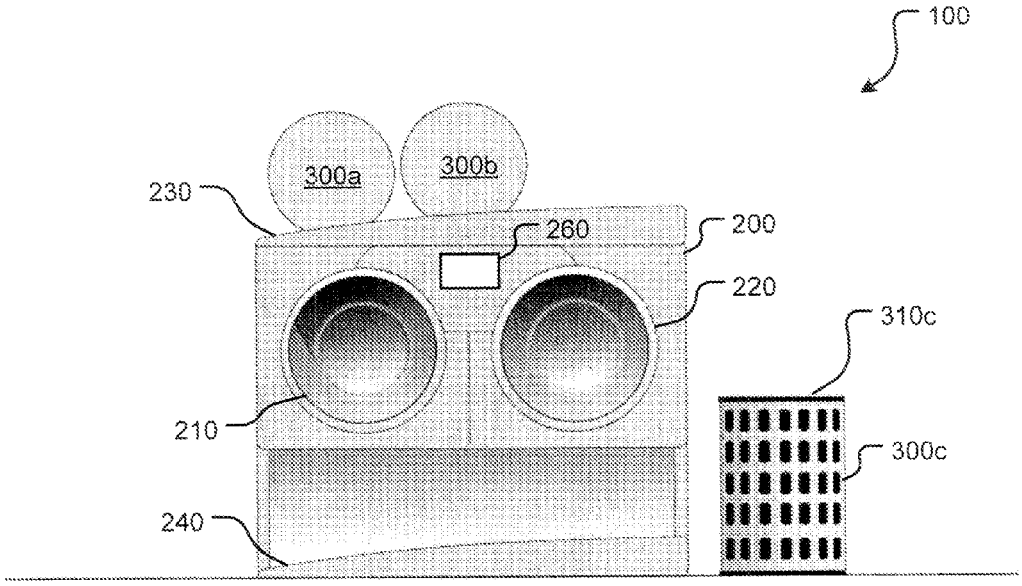
FIG. 1 illustrates an automated laundry system, according to an embodiment.

FIGS. 1-15 illustrate an automated laundry system 100, in accordance with an embodiment, at various stages during operation. With reference to FIG. 1, the automated laundry system 100 includes a washer/dryer unit 200. The washer/dryer unit 200 includes a washing component 210, a drying component 220, a loading rack 230, and a holding rack 240.

The automated laundry system 100 also includes a plurality of perforated clothes drums 300. Each of the clothes drums is meant to hold single load of laundry and, to that end, includes a removable lid 310.

Figure 2:
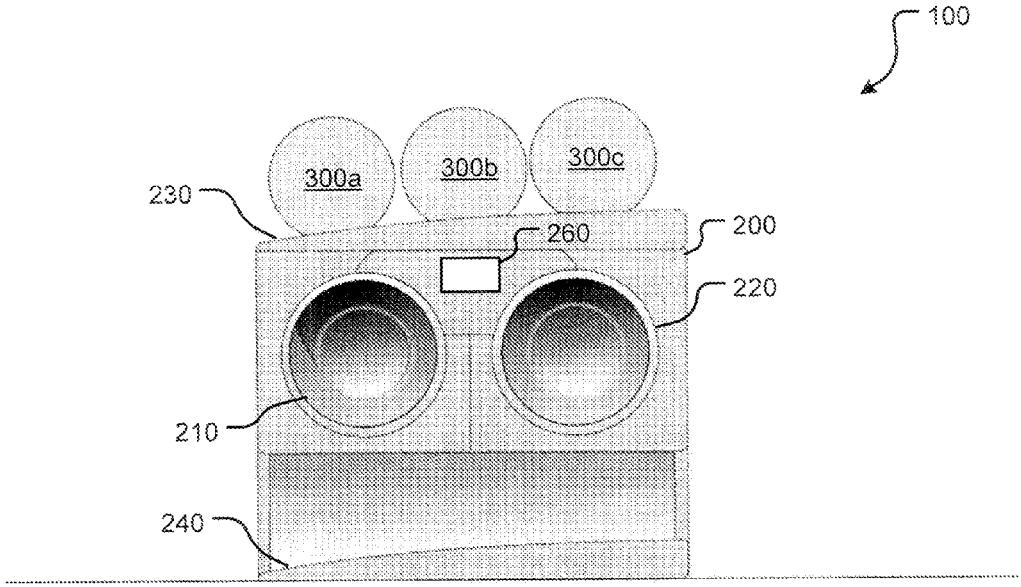
FIG. 2 illustrates an automated laundry system, according to an embodiment, having three clothes drums loaded in a loading rack.

Initially, as shown in FIG. 2, the drums 300, each now containing a load of laundry, are loaded onto the loading rack in 230. As shown, the loading rack 230 may be slightly inclined so as to urge the drums 300 towards the washing component 210. While the embodiment of the loading rack 230 depicted in FIGS. 1-15 is capable of queuing approximately three individual drums 300, it should be appreciated that other configurations of the loading rack 230 are possible in which more or fewer drums may be queued.

Figure 3:
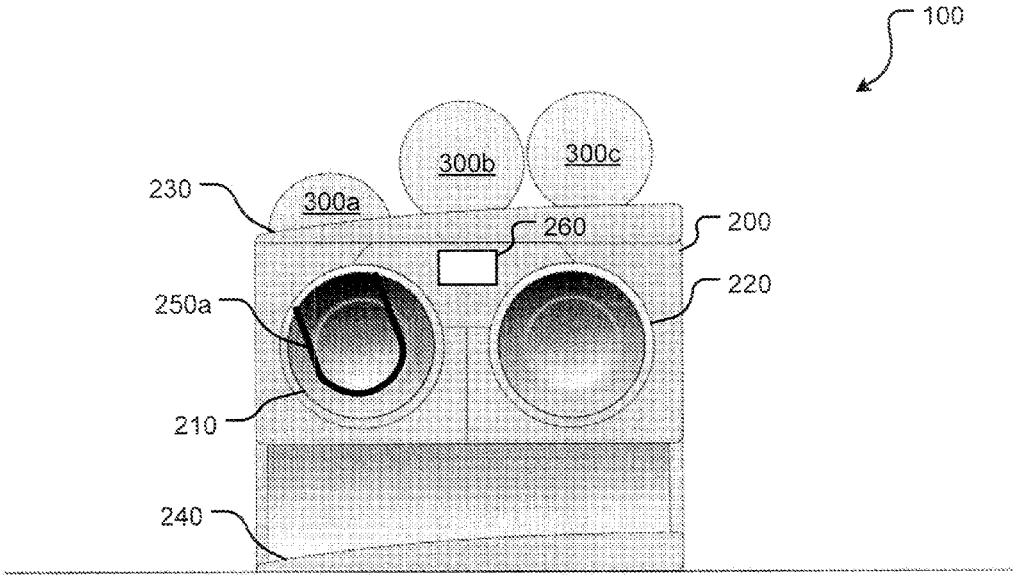
FIG. 3 illustrates an automated laundry system, according to an embodiment, wherein a first clothes drum is being loaded into a clothes washing component.
Figure 4:
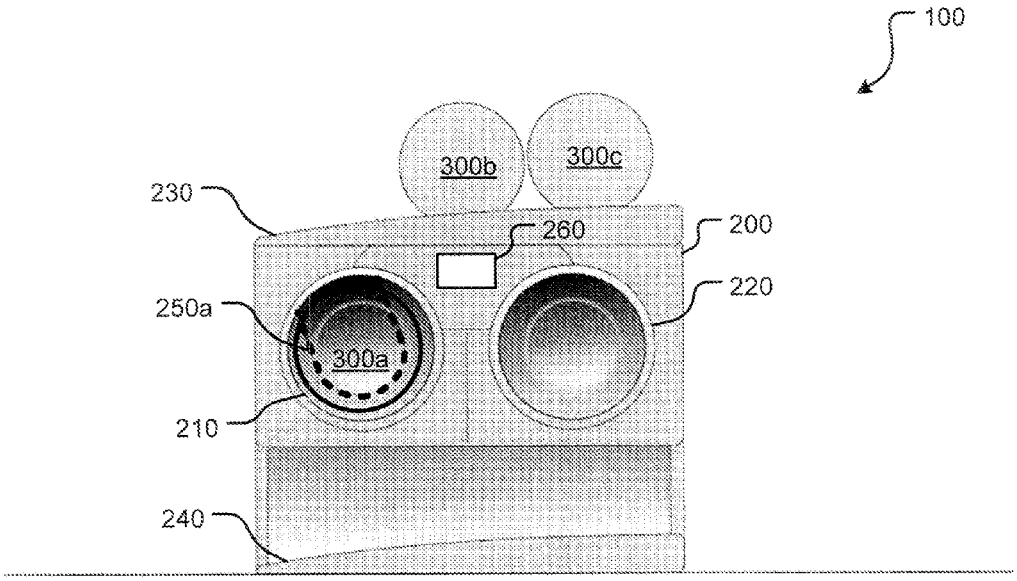
FIG. 4 illustrates an automated laundry system, according to an embodiment, wherein the first clothes drum is fully loaded into the clothes washing component.
Figure 5:
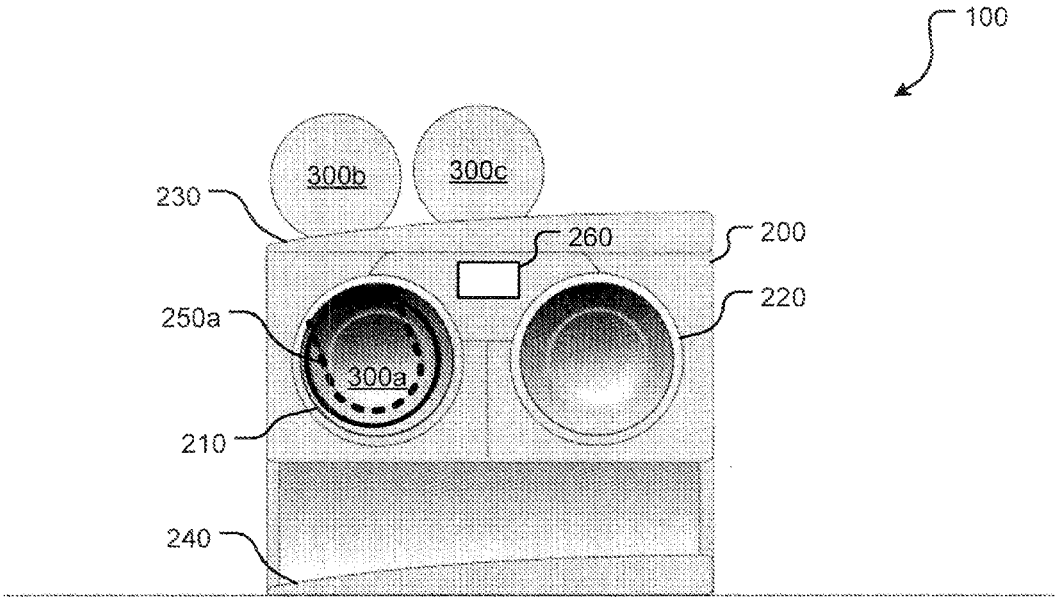
FIG. 5 illustrates an automated laundry system, according to an embodiment, wherein the first clothes drum is fully loaded into the clothes washing component and second and third drums have moved into position for subsequent loading into the clothes washing component.

With reference to FIGS. 3-5, once operation of the automated laundry system 100 begins, the first drum 300*a* is lowered into the washing component 210 through a trap door (not shown) and is guided there by a set of transfer rails 250*a*. Once in the first to drum 300*a* has been loaded into the washing component 210, the washing component 210 begins a wash cycle corresponding to the first drum 300*a*, and the other drums 300*b-c* roll down the loading rack 230 into position.

Figure 6:
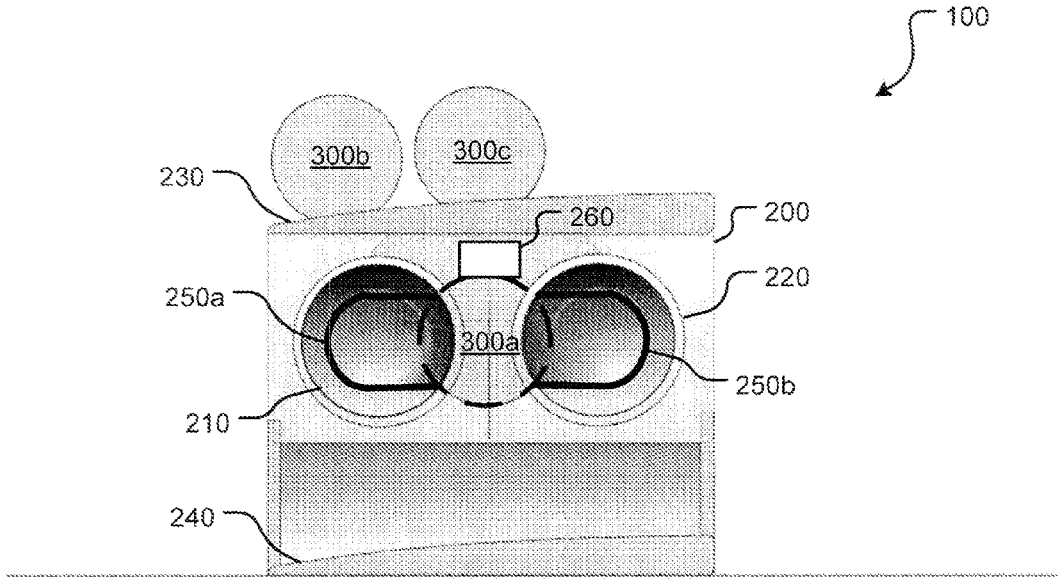
FIG. 6 illustrates an automated laundry system, according to an embodiment, wherein the first clothes drum is being transferred from the clothes washing component to a clothes drying component.

As shown in FIG. 6, just as the washing component 210 includes a set of transfer rails 250*a*, the drying component also includes a set of transfer rails 250*b*. Once the wash cycle corresponding to the first drum 300*a* has completed the transfer rails 250*a-b* orient themselves and cooperate to transfer the first drum 300*a* from the washing component 210 to the drying component 220 via a trap door (not shown) between the components.

Figure 7:
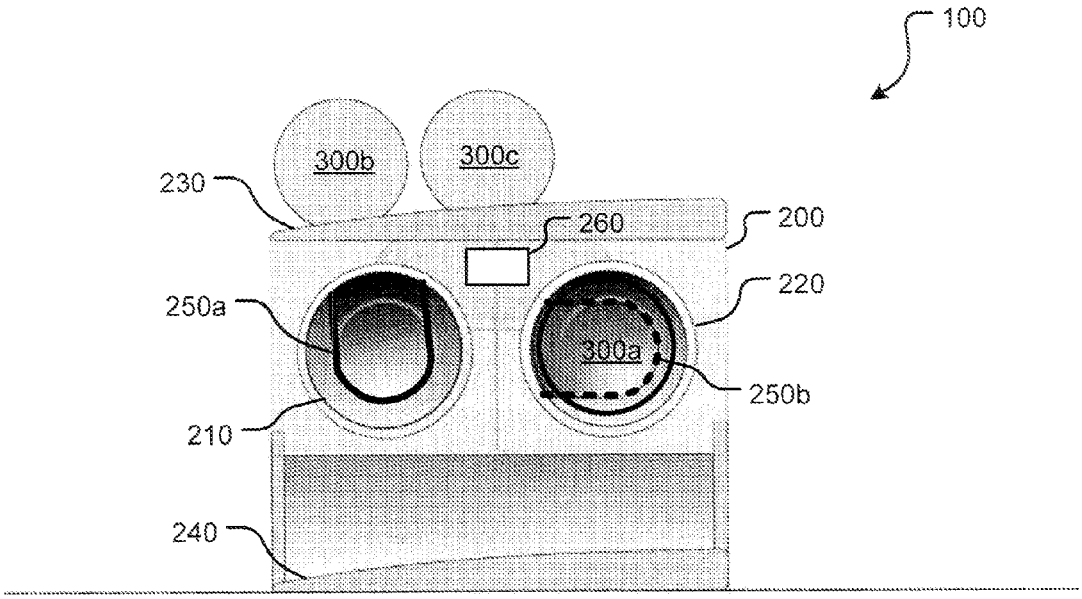
FIG. 7 illustrates an automated laundry system, according to an embodiment, wherein the first clothes drum is fully transferred from the clothes washing component to the clothes drying component.
Figure 8:
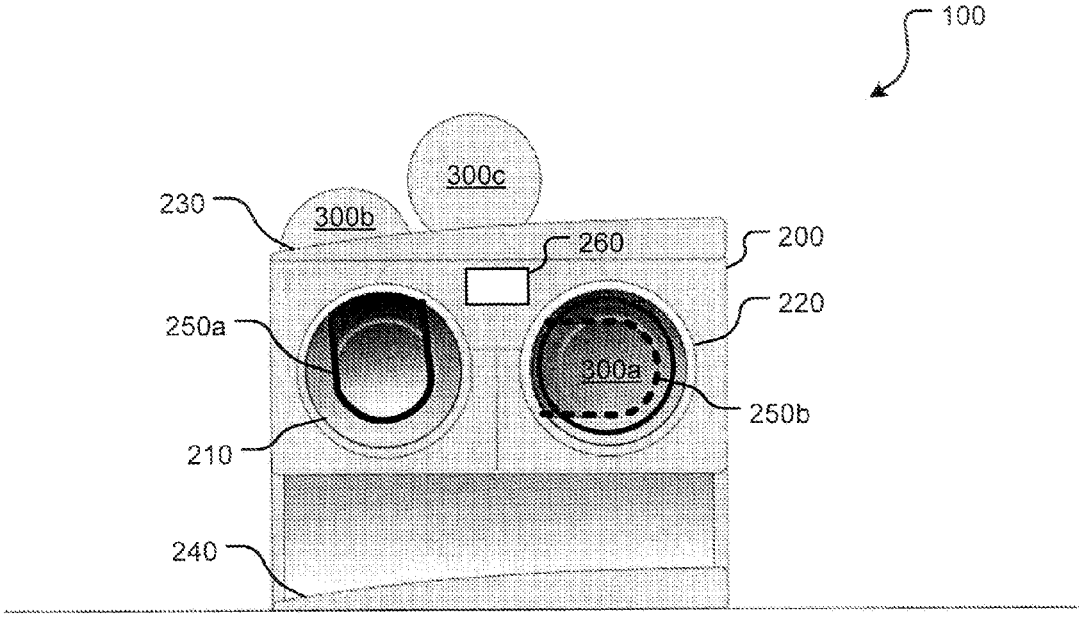
FIG. 8 illustrates an automated laundry system, according to an embodiment, wherein the second clothes drum is being loaded into a clothes washing component while the first clothes drum is dried in the clothes drying component.
Figure 9:
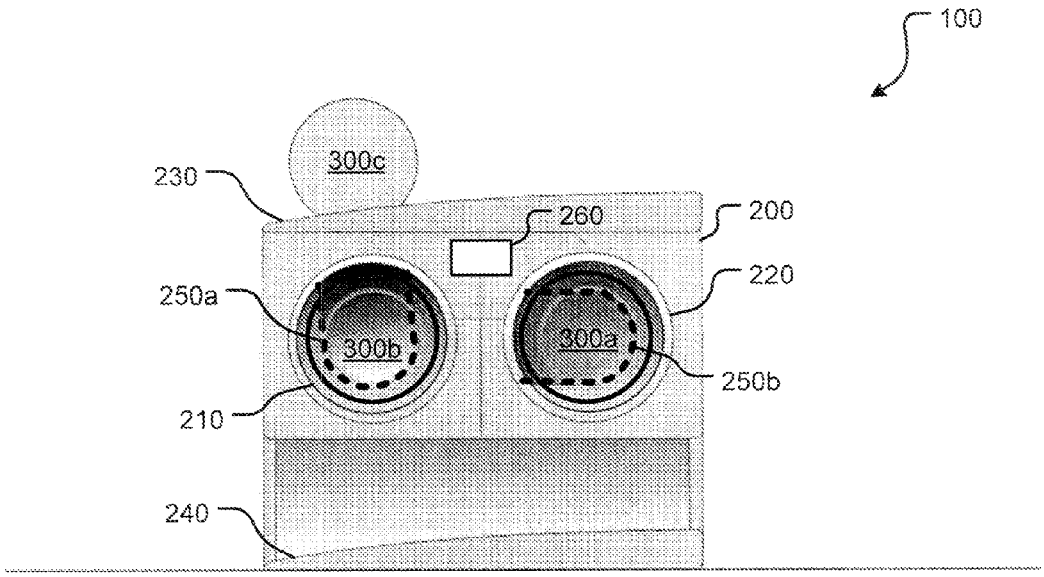
FIG. 9 illustrates an automated laundry system, according to an embodiment, wherein the second clothes drum is fully loaded into the clothes washing component.

With reference to FIGS. 7-9, once the first drum 300*a* has been successfully transferred to the drying component 220, the drying component begins a drying cycle corresponding to the first drum 300*a*. The transfer rails 250*a* of the washing component 210 then reorient themselves so as to receive the second drum 300*b* from the loading rack 230. Once the second drum has been successfully received into the washing component 210, the washing component 210 begins a wash cycle corresponding to the second drum 300*b*. Thus, the automated laundry system 100 is capable of washing one load (e.g. 300*b*) while it dries another (e.g. 300*a*).

Figure 10:
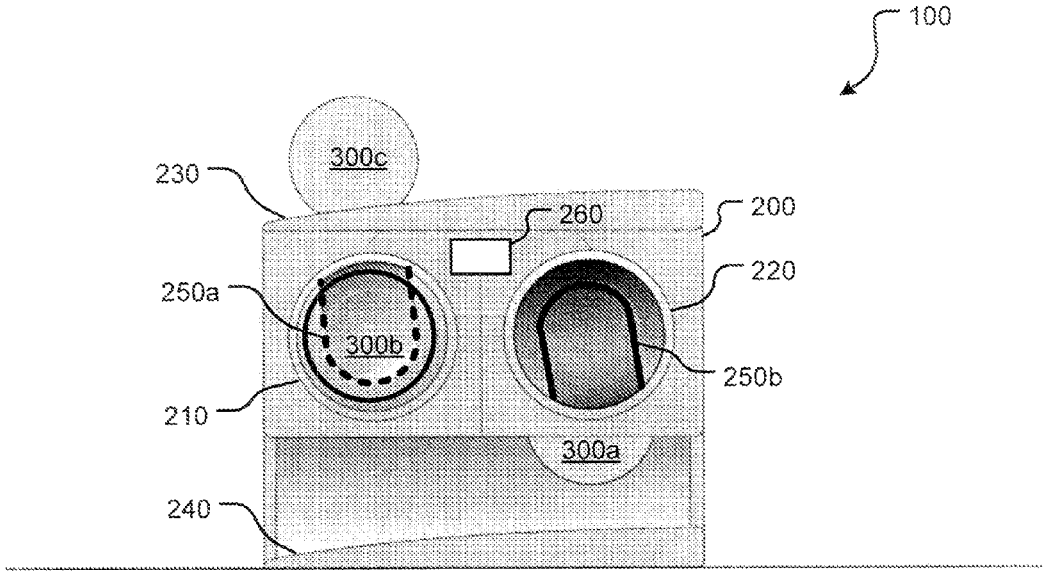
FIG. 10 illustrates an automated laundry system, according to an embodiment, wherein the first clothes drum is being ejected from the clothes drying component.
Figure 11:
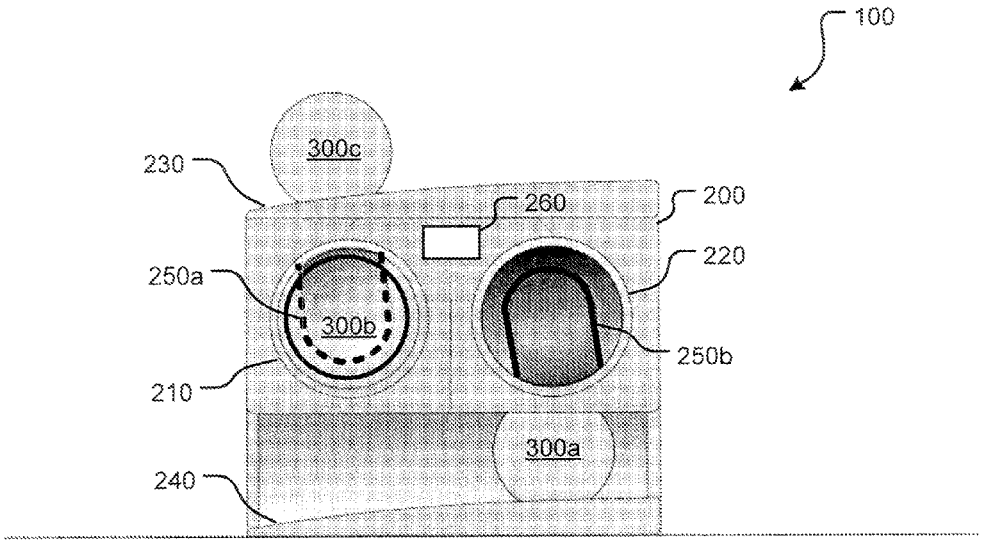
FIG. 11 illustrates an automated laundry system, according to an embodiment, wherein the first clothes drum is fully ejected from the clothes drying component.

As shown in FIGS. 10 and 11, once the drying cycle corresponding to the first drum 300*a* completes, the transfer rails 250*b* of the drying component 220 reorient themselves so as to transfer the first drum 300*a* from the drying component 220 to the holding rack 240 via a trap door (not shown) in the bottom of the drying component 220.

Figure 12:
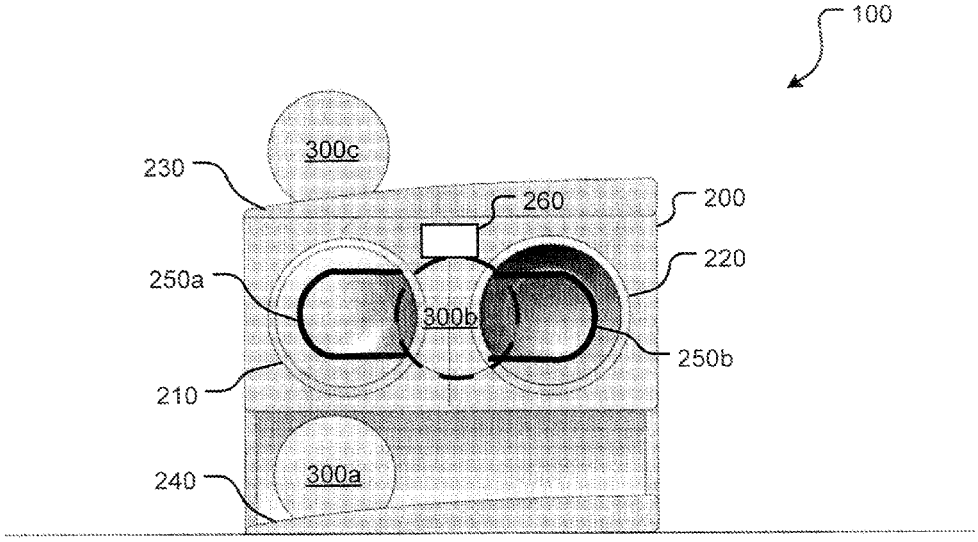
FIG. 12 illustrates an automated laundry system, according to an embodiment, wherein the second clothes drum is being transferred from the clothes washing component to the clothes drying component.

As shown in FIG. 12, the holding rack 240 may have a slight incline so as to urge the drums 300 away from the drying component 220. In one embodiment, the holding rack 240 is configured to hold at least as many drums 300 as the loading rack 230.

Once the first drum 300*a* has been ejected from the drying component 220, the transfer rails 250*a-b* then cooperate to transfer the second drum 300*b* from the washing component 210 to the drying component 220, just as they did with the first drum 300*a*.

Figure 13:
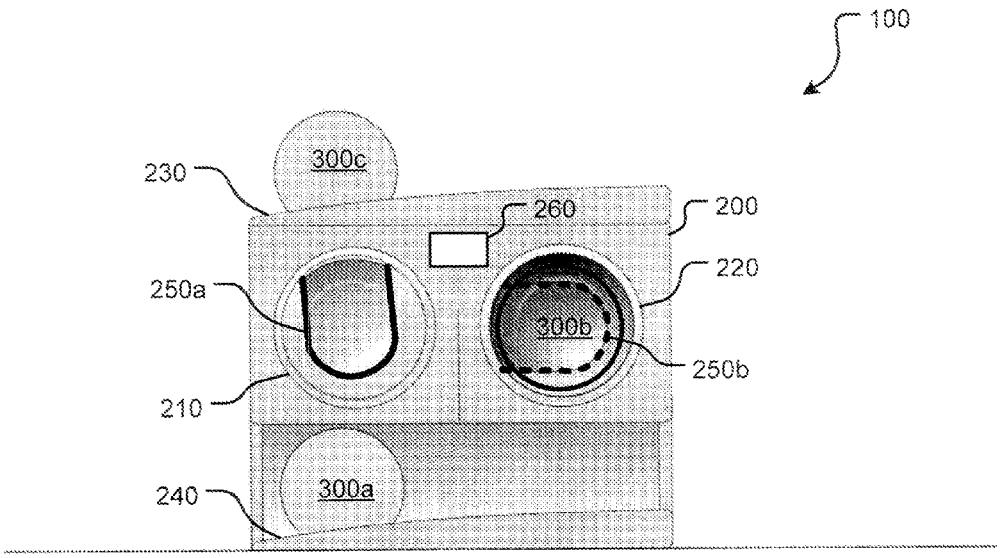
FIG. 13 illustrates an automated laundry system, according to an embodiment, wherein the second clothes drum is fully transferred from the clothes washing component to the clothes drying component.
Figure 14:
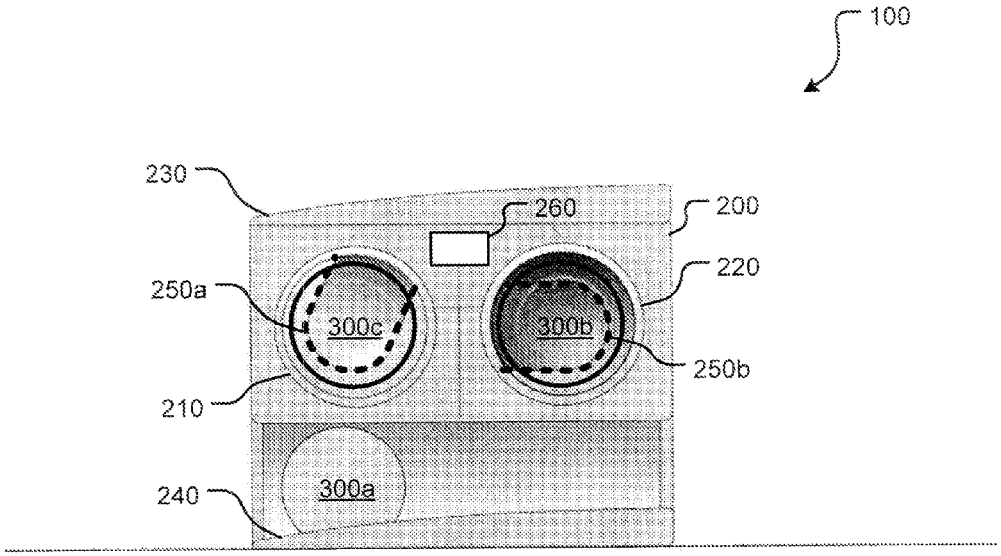
FIG. 14 illustrates an automated laundry system, according to an embodiment, wherein the third clothes drum is being washed in the clothes washing component while the second clothes drum is dried in the clothes drying component.
Figure 15:
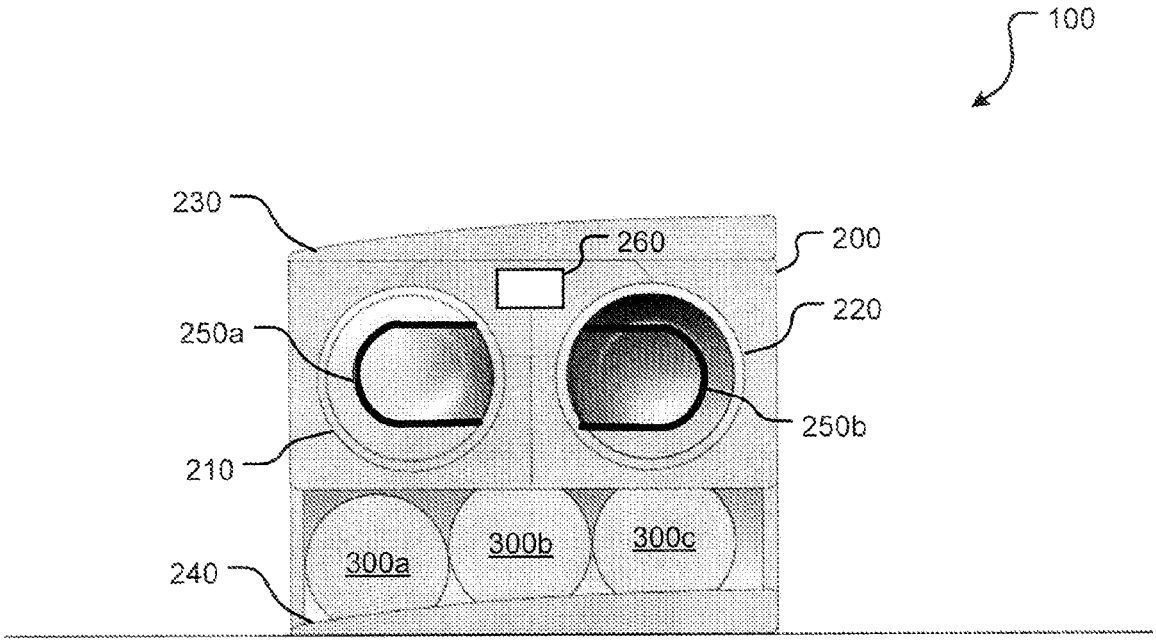
FIG. 15 illustrates an automated laundry system, according to an embodiment, wherein the first, second and third clothes drums are held in a holding rack after washing and drying.

As shown in FIGS. 13-15, the cycle of feeding a drum (e.g. drum 300*c*) into the washing component 210, performing a wash cycle, transferring the drum from the washing component 210 to the drying component 220, performing a drying cycle, and ejecting the drum from the drying component 220 repeats itself until all the drums 300 loaded onto the loading rack 230 have passed through the washing component 210 and the drying component 220.

In one embodiment, the washer/dryer unit 200 includes a user interface 260 for programming and generally controlling the washer/dryer unit 200. FIGS. 16-19 illustrate a user interface 260, according to an embodiment, at various stages of operation. While specific functions and layouts are depicted therein, such functions and layouts are exemplary, and it will be appreciated that other embodiments are possible within the spirit of the present invention.

The user interface 260 may include a number of input buttons 261 and a display 262. In one embodiment, the display 262 may comprise a touchscreen display to provide additional "soft" input functionality. When the washer/dryer unit 200 is not being used, the display 262 may operate in a standby mode wherein the display is either turned off or, for example, simply displays a clock. The display 262 may be awoken from the standby mode by, for example, the pressing of one of the buttons 261. In one embodiment, the display 262 may be logically or physically divided into multiple regions, including but not limited to a programming region 263, a washer status region 264*a*, and a dryer status region 264*b*.

Figure 16:
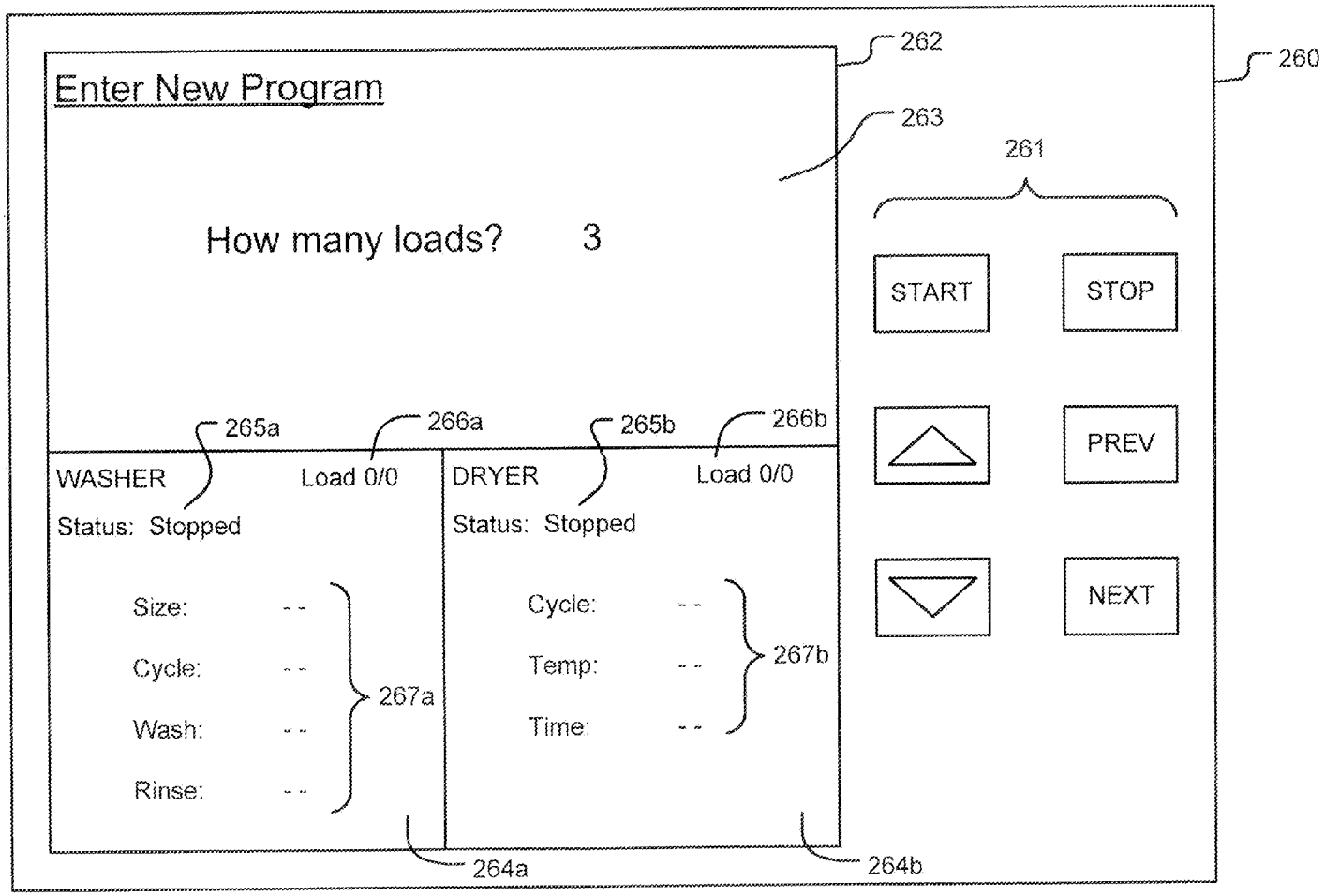
FIG. 16 illustrates a user interface, according to an embodiment, wherein the number of loads to be washed is being solicited.
Figure 17:
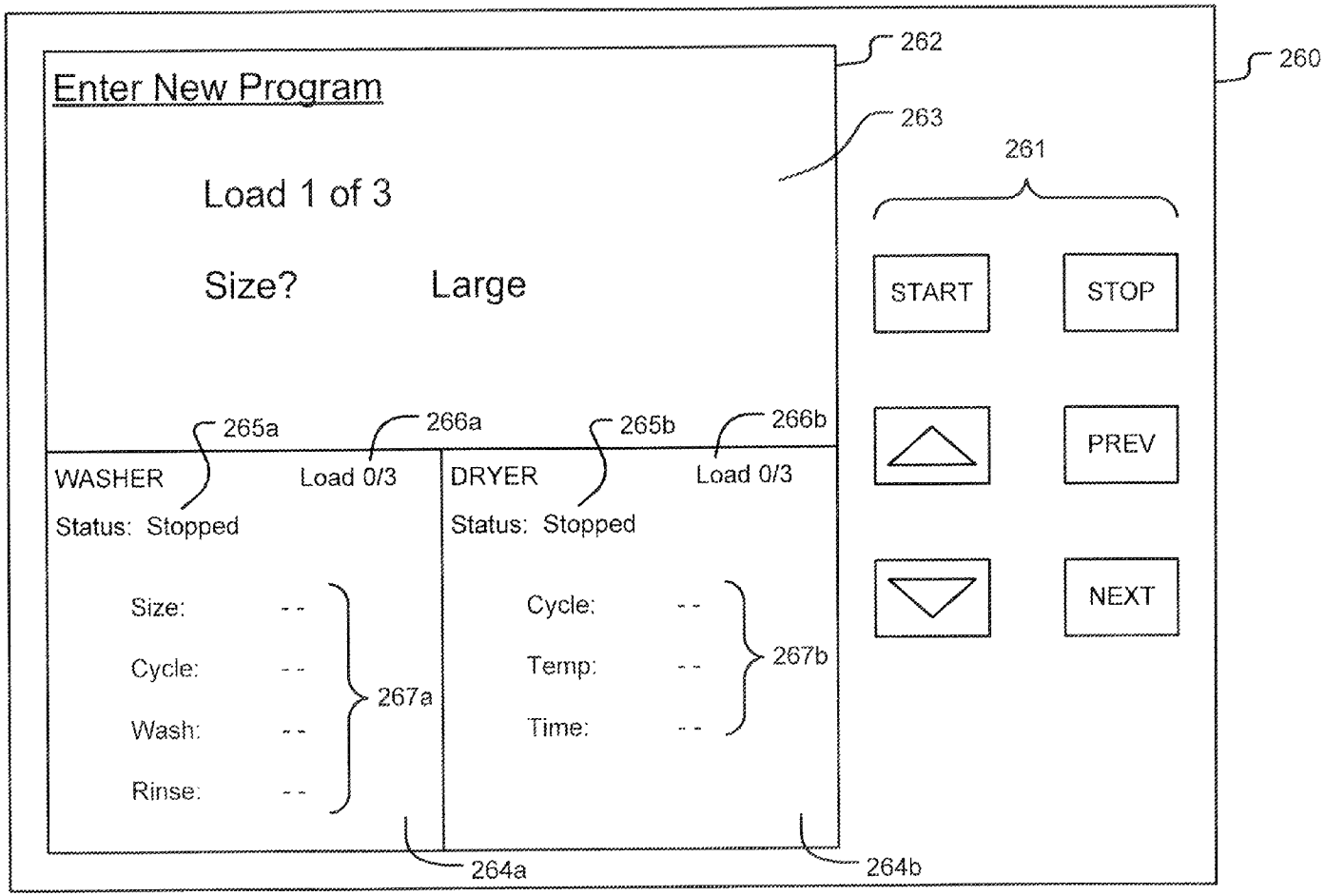
FIG. 17 illustrates a user interface, according to an embodiment, wherein the size of a first load to be washed is being solicited.
Figure 18:
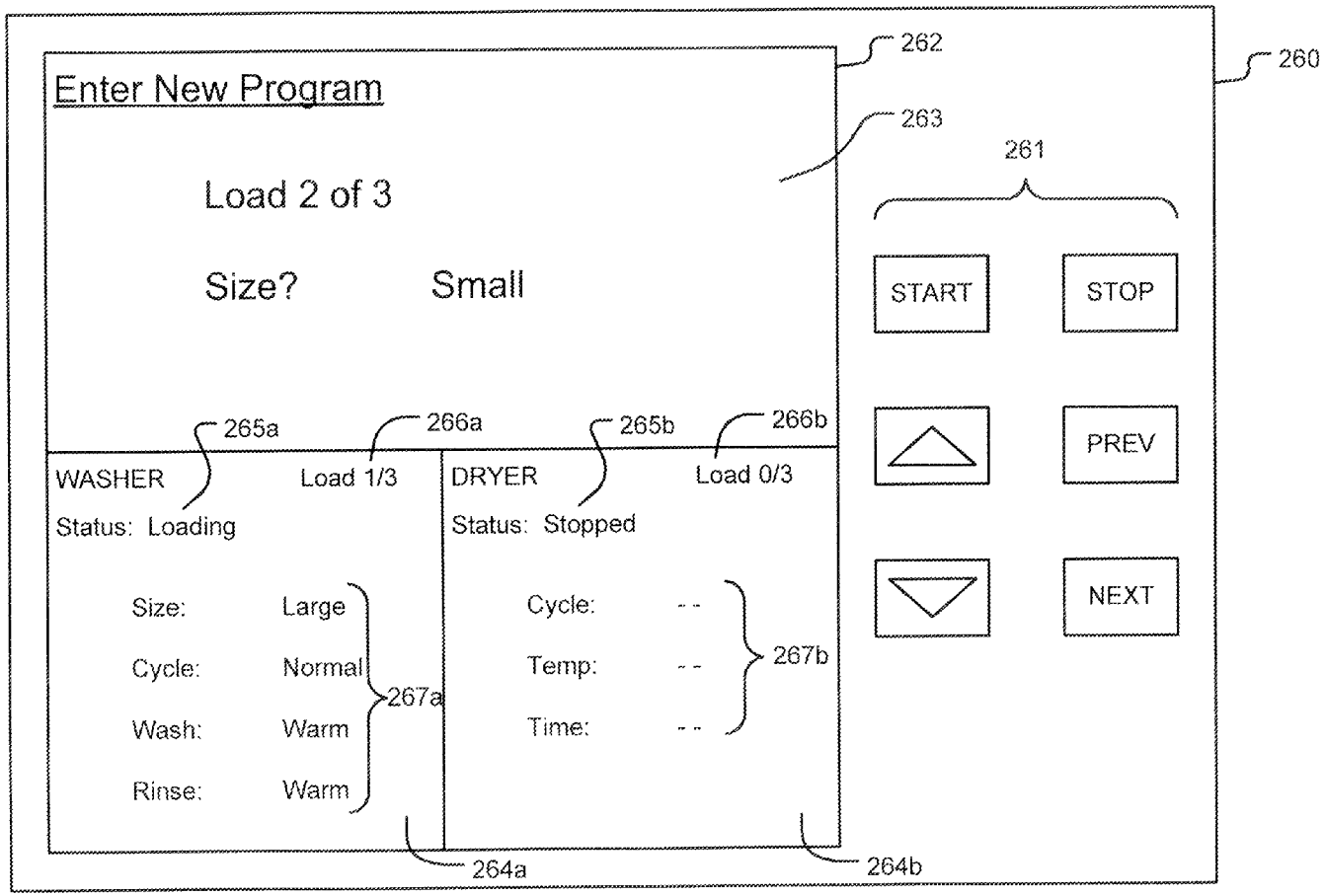
FIG. 18 illustrates a user interface, according to an embodiment, showing the programmed washing settings for the first load and soliciting the size of a second load to be washed.

Once the loading rack 230 has been loaded with one or more drums 300, a user may begin to program the washing and drying settings for the loads by pressing the START button. Initially, as shown in FIG. 16, the user interface 260 may solicit the total number of loads from the user. A user may adjust the number of loads (e.g. 3) one by using the UP and DOWN buttons and then pressing the NEXT button to enter the selection. In an alternative embodiment, a user may simply continue to program loads "on-the-fly". In either case, the user interface 260 may then begin to solicit washing and drying settings from the user on a load by load basis. For example, in FIG. 17, the user interface 260 is asking the user to indicate the size of the first load. Again, the user may scroll through the available load size options (e.g. Small, Medium, Large and X-Large) by utilizing the UP and DOWN arrows and pressing the NEXT button to confirm the selection.

This process of soliciting and receiving washing and drying settings may continue until all the loads have been set. The settings solicited may include, but are not limited to, load size, wash cycle (e.g. normal, gentle, etc.), wash temperature, rinse temperature, whether to use fabric softener and/or bleach, dry cycle (e.g. normal, delicate, permanent press, etc.), dry temperature, and dry time (which may include an automatic setting). The settings are all stored as program information within an internal memory of the washing/drying unit 200. An internal processor or controller then controls the operation of the washing component 210 and the drying component 220 according to these settings. Thus, various embodiments are capable of applying individualized washing and drying settings to individual loads. In one embodiment, the washer/dryer unit 200 includes one or more storage reservoirs for storing laundry detergent, fabric softener, bleach, and the like. Based on the washing settings, the controller can cause these reservoirs to dispense an appropriate amount of the corresponding fluid into the washing component 210.

Figure 19:
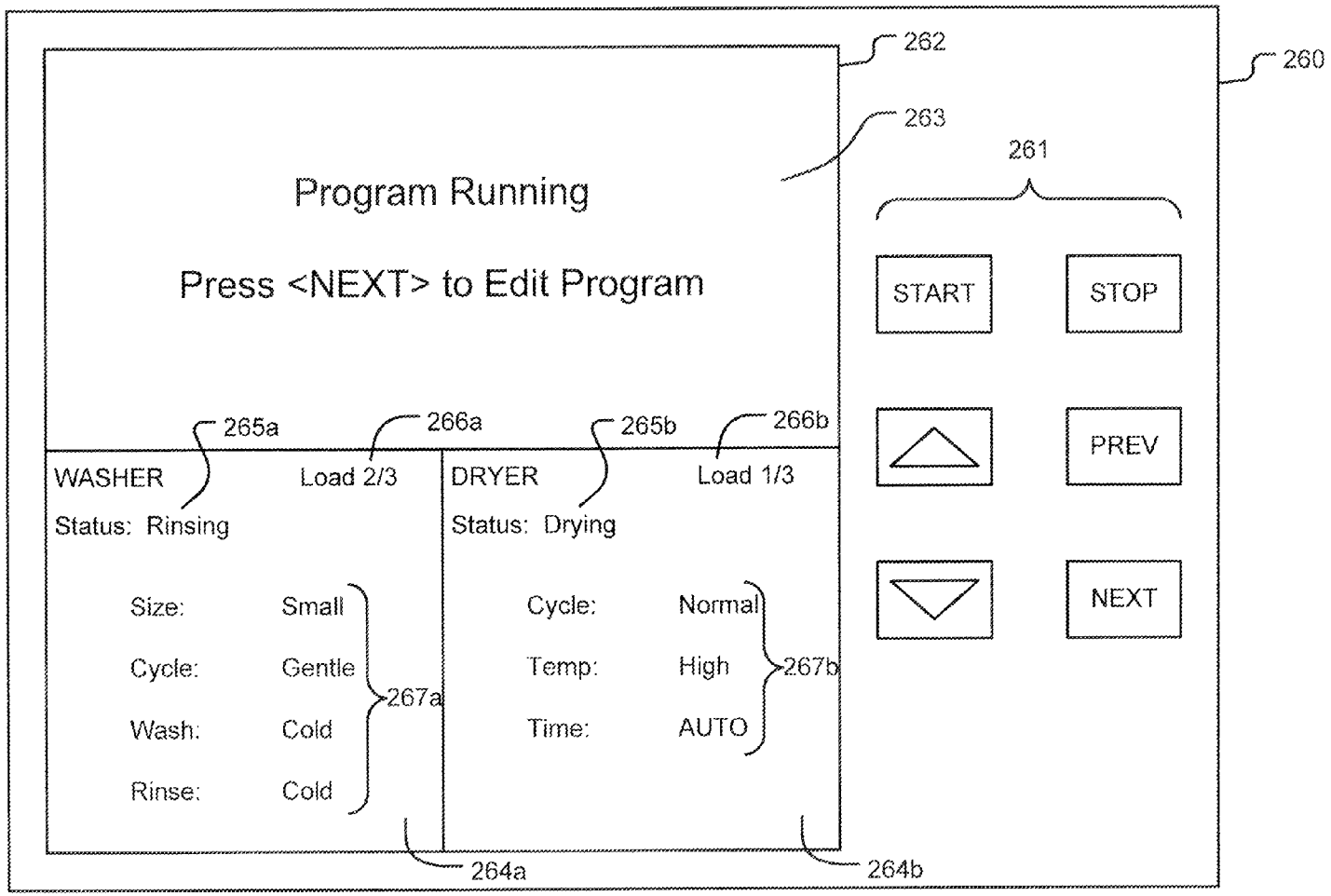
FIG. 19 illustrates a user interface, according to an embodiment, showing the programmed washing settings for a second load and the programmed drying setting for the first load.

In one embodiment, the washing component 210 may load the first drum 300*a* and begin washing the clothes as soon as the wash settings for the first load have been entered. In another embodiment, the washing component 210 may not load the first drum 300*a* until all of the washing/drying settings have been entered and confirmed. Even after all of the loads have been initially entered and the washing/drying unit 200 begins to run, the settings can be subsequently edited (as shown in FIG. 19) to change the settings for a particular load or to add any additional load to the queue. During operation, the washer status region 264*a* and the dryer status region 264*b* of the display 263 may display various status indicators, such as a cycle status indicator 265, a load indicator 266, and a cycle settings indicator 267 (see e.g., FIGS. 17-19).

Thus, embodiments provide for an automated laundry system that is suitable for household use and capable of queuing multiple loads. Advantageously, embodiments utilize a plurality of clothes drums—which may also double as hampers—to keep individual loads separate. This guarantees that the loads stay separated throughout the entire washing and drying process. It further guarantees that the entire load gets transmitted from component to component of the system. In other words, the above-referenced problems of clothes sticking to the side of a washer or dryer drum or snagging during transmittal from one component to another are eliminated. Because the clothes drums of the present invention provide for certainty in delimiting one load from the next, each load can be washed per individualized settings. The aforementioned advantages all add up to more free time and less hassle for the consumer.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An automated laundry system comprising:

a plurality of perforated clothes drums, each of the drums for holding a single load of laundry; and a washer/dryer unit comprising:

a loading rack for queuing the drums for subsequent washing;

a clothes washing component adapted to sequentially receive the drums from the loading rack and wash the respective loads of laundry therein;

a clothes drying component adapted to sequentially receive the drums from the clothes washing component and dry the loads of laundry therein; and a holding rack for sequentially receiving the drums from the clothes drying component and holding the drums for a period of time, wherein the clothes washing component comprises a first set of transfer rails orientable between a first orientation for receiving the drums from the loading rack and a second orientation for transmitting the drums to the clothes drying component, and wherein the clothes drying component comprises a second set of transfer rails orientable between a first orientation for receiving the drums from the clothes washing component and a second orientation for transmitting the drums to the holding rack.

2. The automated laundry system as recited in claim 1 wherein the perforated clothes drums comprise wire-mesh cylinders.

3. The automated laundry system as recited in claim 1 wherein the perforated clothes drums include removable lids.

4. The automated laundry system as recited in claim 1 wherein the washer/dryer unit further comprises a trap-door disposed between the loading rack and the clothes washing component.

5. The automated laundry system as recited in claim 1 wherein the washer/dryer unit further comprises a trap-door disposed between the clothes washing component and the clothes drying component.

6. The automated laundry system as recited in claim 1 wherein the washer/dryer unit further comprises a trap-door disposed between the clothes drying component and the holding rack.

7. The automated laundry system as recited in claim 1 wherein the washer/dryer unit further comprises a reservoir for storing a laundry fluid.

8. The automated laundry system as recited in claim 7 wherein the laundry fluid is selected from the group consisting of laundry detergent, fabric softener and bleach.

9. The automated laundry system as recited in claim 7 wherein the clothes washing component is operable to dispense an appropriate amount of the laundry fluid during a wash cycle, based at least in part on a user-adjustable washing parameter.

10. The automated laundry system as recited in claim 1 wherein the loading rack is at least partially inclined so as to urge the drums towards the clothes washing component.

11. The automated laundry system as recited in claim 1 wherein the holding rack is at least partially inclined so as to urge the drums away from the clothes drying component.

12. The automated laundry system as recited in claim 1 further comprising:

a memory for storing a laundry program for each of the drums; and a controller coupled to the clothes washing and clothes drying components, the controller adapted to cause the clothes washing and clothes drying components to, respectively, wash and dry each of the loads of laundry in the drums according to a respective one of the laundry programs.

13. The automated laundry system as recited in claim 12, comprising a user interface configured to receive input defining a laundry program for each of the drums.

14. In the automated laundry system of claim 1, a method for washing multiple loads of laundry, comprising:

providing a memory for storing washing and drying settings corresponding to each of the loads held in the plurality of perforated clothes drums;

providing a user interface having a display;

receiving first washing and drying settings corresponding to a first load of laundry via the user interface;

storing the first washing and drying settings in the memory;

receiving second washing and drying settings corresponding to a second load of laundry via the user interface;

storing the second washing and drying settings in the memory;

washing the first load of laundry according to the first washing and drying settings;

drying the first load of laundry according to the first washing and drying settings;

washing the second load of laundry according to the second washing and drying settings; and drying the second load of laundry according to the second washing and drying settings.

15. The method as recited in claim 14 wherein the second washing and drying settings at least partially differ from the first washing and drying settings.

16. The method as recited in claim 14 further comprising: receiving, via the user interface, an indication of a number of loads of laundry to be washed.

17. The method as recited in claim 14 further comprising: successively soliciting, via the user interface, washing and drying settings for each of the number of loads of laundry to be washed.

18. The method as recited in claim 14 wherein washing the first load of laundry according to the first washing and drying settings comprises: dispensing an appropriate amount of detergent into the washer based on the first washing and drying settings.

19. The method as recited in claim 14 wherein washing the second load of laundry according to the second washing and drying settings comprises: washing the second load of laundry for a period of time while the first load of laundry is simultaneously being dried.

20. An automated laundry system comprising:

a loading component operable to queue at least two drums of individual, separated loads of laundry;

a washing component operable to receive from the loading component, and wash, in succession, each of the at least two loads, wherein the drums are received at the washing component from the loading component in a direction perpendicular to a rotational axis of the drums;

a drying component operable to receive from the washing component, dry, and eject from the drying component, in succession, each of the at least two loads;

a memory configured to store at least two laundry programs, each of the at least two laundry programs associated with a respective one of the queued at least two individual, separated loads of laundry; and a controller coupled to the washing and drying components, the controller configured to cause the washing and drying components to, respectively, wash and dry each of the at least two loads according to a respective one of the at least two laundry programs.

21. The automated laundry system as recited in claim 20:

wherein the washing component comprises a first set of transfer rails orientable between a first orientation for receiving the drums from the loading component and a second orientation for transmitting the drums to the drying component, and wherein the drying component comprises a second set of transfer rails orientable between a first orientation for receiving the drums from the clothes washing component and a second orientation for ejecting the drums from the drying component.

22. The automated laundry system as recited in claim 20, comprising a user interface configured to receive input defining each of the at least two laundry programs associated with the respective one of the queued at least two drums of individual, separated loads of laundry.

* * * * *